US012071813B2

(12) United States Patent
Alkalla et al.

(10) Patent No.: US 12,071,813 B2
(45) Date of Patent: Aug. 27, 2024

(54) DRILL

(71) Applicant: University of Surrey, Surrey (GB)

(72) Inventors: Mohamed Alkalla, Surrey (GB); Yang Gao, Surrey (GB)

( * ) Notice: Subject to any disclaimer, the term of this patent is extended or adjusted under 35 U.S.C. 154(b) by 0 days.

(21) Appl. No.: 17/996,782

(22) PCT Filed: Apr. 16, 2021

(86) PCT No.: PCT/GB2021/050914
§ 371 (c)(1),
(2) Date: Oct. 20, 2022

(87) PCT Pub. No.: WO2021/214431
PCT Pub. Date: Oct. 28, 2021

(65) Prior Publication Data

US 2023/0151693 A1 May 18, 2023

(30) Foreign Application Priority Data

Apr. 20, 2020 (GB) ..... 2005716

(51) Int. Cl.
*E21B 1/14* (2006.01)
*E21B 10/36* (2006.01)
*E21B 15/04* (2006.01)

(52) U.S. Cl.
CPC ..... *E21B 1/14* (2020.05); *E21B 10/36* (2013.01); *E21B 15/04* (2013.01)

(58) Field of Classification Search
CPC . E21B 1/14; E21B 49/02; E21B 15/04; E21B 10/36
See application file for complete search history.

(56) References Cited

U.S. PATENT DOCUMENTS 748,054 A * 12/1903 Double ..... E21B 10/325 175/281
820,101 A 5/1906 Edward
(Continued)

FOREIGN PATENT DOCUMENTS

CN 106703684 8/2018
WO WO 0246564 * 6/2002 ..... E21B 1/14

OTHER PUBLICATIONS

International Search Report, World Intellectual Property Office, Oct. 28, 2021.

*Primary Examiner* — Yong-Suk (Philip) Ro
(74) *Attorney, Agent, or Firm* — CIONCA IP Law P.C.

(57) ABSTRACT

A drill comprising a drill bit comprising a first drill part and a second drill part configured to slide relative to each other, wherein the first and second drill parts are pivotally coupled at one end to a first member and a second member respectively; a cam engaged with the first member and the second member, wherein the first and second members act as followers to slide the parts of the drill bit in a reciprocating motion with respect to each other, between a retracted and an extended position; and a wedge comprising a first angled surface engaged with the first member and a second angled surface engaged with the second member, the wedge configured to urge the drill bit to pivot in a first direction when the first member is moved towards the retracted position and to pivot in a second direction when the second member is moved towards the retracted position.

15 Claims, 8 Drawing Sheets

(56) References Cited

U.S. PATENT DOCUMENTS

| | | | | | |
|---|---|---|---|---|---|
| 1,388,105 | A * | 8/1921 | Double | E21B 10/325 | 175/281 |
| 1,656,436 | A * | 1/1928 | Heggem | E21B 10/66 | 175/278 |
| 2,124,414 | A | 7/1938 | Goldman | | |
| 2,620,162 | A * | 12/1952 | Pennington | E21B 4/14 | 173/137 |
| 3,322,216 | A * | 5/1967 | Kurt | E21B 4/06 | 173/132 |
| 4,852,672 | A * | 8/1989 | Behrens | E21B 10/38 | 175/215 |
| 5,390,749 | A * | 2/1995 | Lyon | E21B 17/076 | 175/417 |
| 2012/0118648 | A1* | 5/2012 | Lorger | E21B 4/14 | 175/296 |
| 2013/0186692 | A1* | 7/2013 | Purcell | E21B 17/076 | 175/296 |
| 2019/0345772 | A1* | 11/2019 | Bruandet | E21B 34/06 | |
| 2020/0347678 | A1* | 11/2020 | Välisalo | E21B 4/14 | |

* cited by examiner

DRILL

TECHNICAL FIELD

The present disclosure relates to a drill and a method of using a drill.

BACKGROUND

Rotary drilling typically requires a large overhead force to push the drill into a substrate. Percussive drilling usually requires a lower overhead force to operate, but its penetration rate in rocks is often poor, and may only be effective at shallow depths. Rotary-percussive drills are able to use the rotary technique to drill significant depths, with the addition of percussive shocks reducing the overhead requirement, though they can be heavy, complex systems. There remains a need for developments in this field.

SUMMARY OF THE INVENTION

According to the present disclosure, there is provided a drill comprising: a drill bit comprising a first drill part and a second drill part configured to slide relative to each other, wherein the first and second drill parts are pivotally coupled at one end to a first member and a second member respectively; a cam engaged with the first member and the second member, wherein the first and second members act as followers to slide the parts of the drill bit in a reciprocating motion with respect to each other, between a retracted and an extended position; and a wedge comprising a first angled surface engaged with the first member and a second angled surface engaged with the second member, the wedge configured to urge the drill bit to pivot in a first direction when the first member is moved towards the retracted position and to pivot in a second direction when the second member is moved towards the retracted position.

The cam may be a cylindrical cam and the first and second members may extend on opposite sides of the cylindrical cam to transform rotational movement of the cylindrical cam to a linear reciprocating motion of the first and second members.

The drill may further comprise a motor to actuate both the reciprocating and pivot motions.

The first and second angled surfaces of the wedge may be a pair of surfaces having the same angle of incline, such that, in use, an angle through which the drill bit pivots in the first direction may be the same as an angle through which the drill bit pivots in the second direction.

The first member may comprise a hinge joint to pivotally couple to the first drill part and the second member may comprise a hinge joint to pivotally couple to the second drill part.

The hinge joint may comprise rounded contact points that engage each angled surface of the wedge.

The drill may further comprise a biasing means acting on the first and the second member to urge the first and the second members towards engagement with the angled surfaces of the wedge.

The first drill part may be coupled to the second drill part by an interlocking connection that may prevent lateral movement or rotation of the first drill part relative to the second drill part.

One of the first drill part and the second drill part may comprise a pin and the other of the first drill part and the second drill part may comprise a track, wherein the pin may be configured to travel within the track.

The drill may further comprise a chamber for the ingress of material to be sampled.

The drill may further comprise an openable cover to open and close the chamber.

The chamber may be provided at a location between the wedge and the cam, wherein the wedge may be closer to the drill bit than the cam.

The drill may further comprise a guide member for engagement with the first member and the second member. The guide member may comprise slots, and the first member and the second member may be configured to slide within said slots to guide the reciprocation motion. The guide member may be a sleeve disposed within an outer shell of the drill.

The drill may comprise a sealed housing to encapsulate the first and second members, the wedge and the cam, which may protect them from external environmental conditions.

According to the present disclosure, there is also provided a method of using the drill, wherein the method comprises: rotating the cam engaged with the first member and the second member, wherein the first and second members act as followers to slide the parts of the drill bit in a reciprocating motion with respect to each other, between a retracted and an extended position; and sliding one part of the drill bit into the retracted position, wherein the wedge urges the drill bit to pivot in a first direction as the first member is moved towards the retracted position and/or sliding the other part of the drill bit into the retracted position, wherein the wedge urges the drill bit to pivot in a second direction as the second member is moved towards the retracted position.

BRIEF DESCRIPTION OF THE DRAWINGS

One or more embodiments of the invention will now be described, by way of example only, with reference to the accompanying schematic drawings, in which.

DETAILED DESCRIPTION

Figure 1:
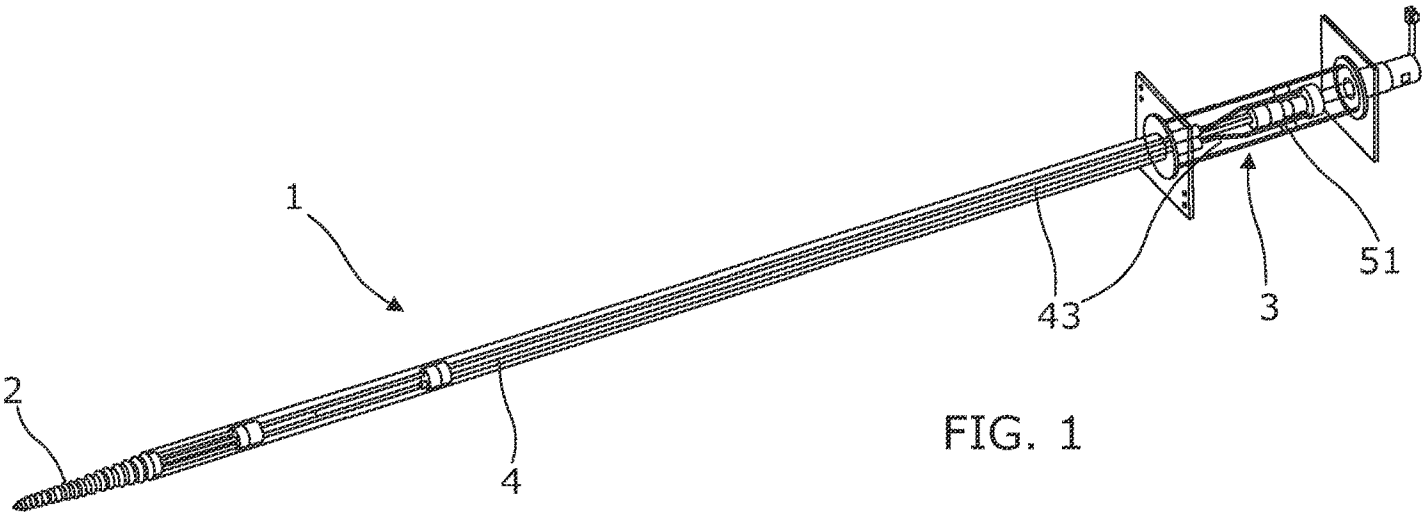
FIG. 1 shows a drill according to an embodiment of the invention.

The scope of protection sought for various embodiments of the invention is set out by the independent claims. The embodiments and features, if any, described in the specification that do not fall under the scope of the independent claims are to be interpreted as examples useful for understanding various embodiments of the invention.

In the description and drawings, like reference numerals refer to like elements throughout.

Drilling systems play a critical role in planetary exploration missions. Rotary drills are commonly used in terrestrial applications, however the large masses needed to provide the overhead force necessary to push the drill into the substrate make them less suitable for planetary exploration. For example, both the stringent mass constraints imposed upon a mission and low gravity on some other bodies such as the Moon and Mars may make at least some rotary drills unsuitable for such applications.

Percussive drilling involves vibrating the drill bit. Whilst percussive drilling typically requires a lower overhead mass to operate, its penetration rate in rocks is often poor, and may only be effective at relatively shallow depths. Rotary-percussive drills are able to use the rotary technique to drill significant depths, with the addition of percussive shocks reducing the overhead requirement. Despite being heavy, complex systems, they have been used on several space missions.

The terms substrate, material, rock, medium and drilling medium as used herein are generally interchangeable and refer to a medium through which a drill is operating a drilling action.

The term drilling action as used herein generally refers to an operation of a drill in a medium, for example to form a bore in the medium.

A drill 1 according to a first embodiment is described herein with reference to FIGS. 1 to 7.

FIG. 1 shows a drill 1 for providing reciprocation and oscillation motion. The drill 1 comprises a drill bit 2, an actuation mechanism 3 and a stem 4 extending between the drill bit 2 and the actuation mechanism 3. The drill comprises a housing 43 including a cylindrical hollow outer shell of the stem 4 and a casing 51 of the actuation mechanism 3.

Figure 2:
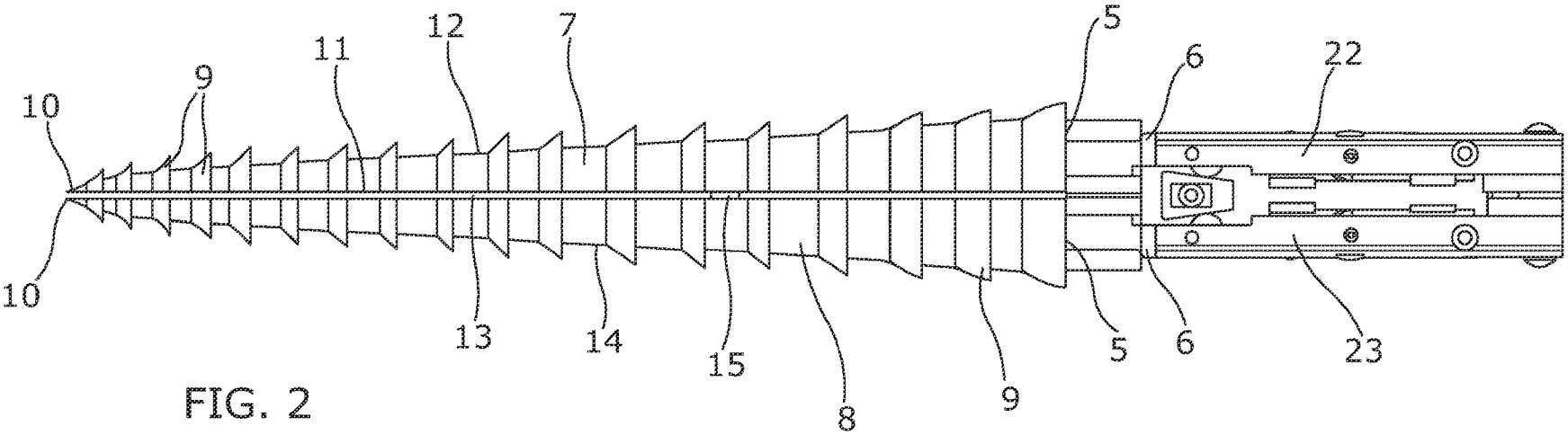
FIG. 2 shows a drill bit of the drill of FIG. 1 comprising first and second parts.

FIG. 2 shows the drill bit 2 in more detail. The drill bit 2 comprises a first drill part 7 and a second drill part 8, herein referred to as a first part 7 and a second part 8 for ease of description. As illustrated in FIG. 2 the first part 7 comprises one half of the drill bit 2 and the second part 8 comprises a second half of the drill bit 2. The drill bit 2 comprises a tip 10 at its distal end, and a base 5 at its proximal end.

The term proximal as used herein is intended to mean a direction away from the tip 10 of the drill bit 2. The term distal as used herein is intended to mean a direction towards the tip 10 of the drill bit.

The first part 7 comprises a first mating face 11 and a first external face 12, the second part 8 comprises a second mating face 13 and a second external face 14. The first part 7 is configured to engage the second part 8 at their respective mating faces 11, 13, via an interlocking connection 15 (shown and further described in reference to FIG. 3), such that the first part 7 is configured to slide relative to the second part 8. The mating faces 11, 13 are substantially flat surfaces, such that when the mating surfaces 11, 13 are engaged, there is negligible space between them. This tends to prevent any material from being caught between the mating faces 11, 13 which may affect the sliding motion of the first and second parts 7, 8.

The first part 7 is pivotally coupled at its base 5 to a first member 22 by a hinge joint or oscillating rod 6, and the second part 8 is pivotally coupled at its base 5 to a second member 23 by a hinge joint or oscillating rod 6. The first and second members 22, 23, extend linearly through the stem 4, away from the drill bit 2 to the actuation mechanism 3. The first and second members 22, 23 are moved by the actuation mechanism 3 (described in more detail below with reference to FIG. 4) in a reciprocating motion, to slide the first part 7 and the second part 8 of the drill bit 2 relative to each other.

Each of the first part 7 and the second part 8 further comprises a plurality of teeth 9 on the external face 12, 14. The teeth 9 of the first part 7 are substantially symmetrical to the teeth 9 of the second part 8. The teeth 9 extend away from the tip 10 of the drill bit, in a proximal direction, and are spaced along a length of the first part 7 and the second part 8. The teeth 9 reduce in pitch size towards the tip 10. The teeth 9 are configured to engage a surrounding substrate during a drilling action. Advantageously the teeth 9 can be customised for the particular medium to be drilled.

Figure 3:
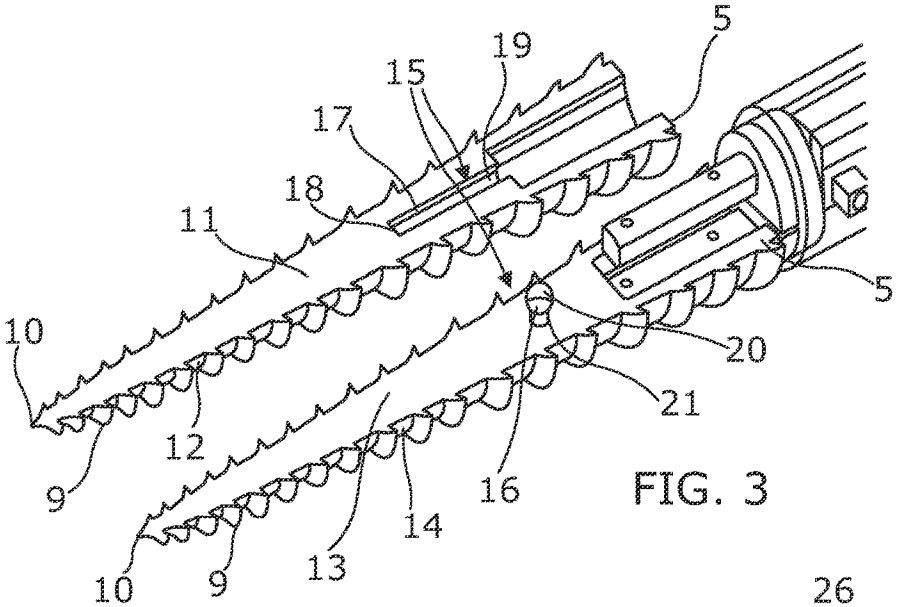
FIG. 3 shows an interlocking mechanism of the drill bit of FIG. 2.

FIG. 3 shows a more detailed view of the interlocking connection 15 that seeks to prevent lateral movement or rotation of the first part 7 relative to the second part 8. One of the first part 7 and the second part 8 comprises a pin 16, and the other of the first part 7 and the second part 8 comprises a slot or track 17. In the embodiment illustrated in FIG. 3 the first mating face 11 comprises the track 17 and the second mating face 13 comprises the pin 16. The pin 16 engages the track 17 and is moveable is between a distal position where the pin is 16 is located in a first end 18 of the track 17, to a proximal position where the pin 16 is located in a second end 19 of the track 17.

The pin 16 comprises a head 20 and a neck 21, wherein the neck 21 extends between the head 20 and the mating face 13. The head 20 has a larger cross sectional area than the neck 21 and the track 17 has a shape complimentary to the head 20 of the pin 16 that narrows around the neck 21, such that the head 20 can be fully retained within the track 17. The first part 7 is therefore able to slide with respect to the second part 8, but is prevented from separating from the second part 8. As illustrated in FIG. 3 the head 20 and track 17 are rounded in shape, substantially spherical.

Figure 4:
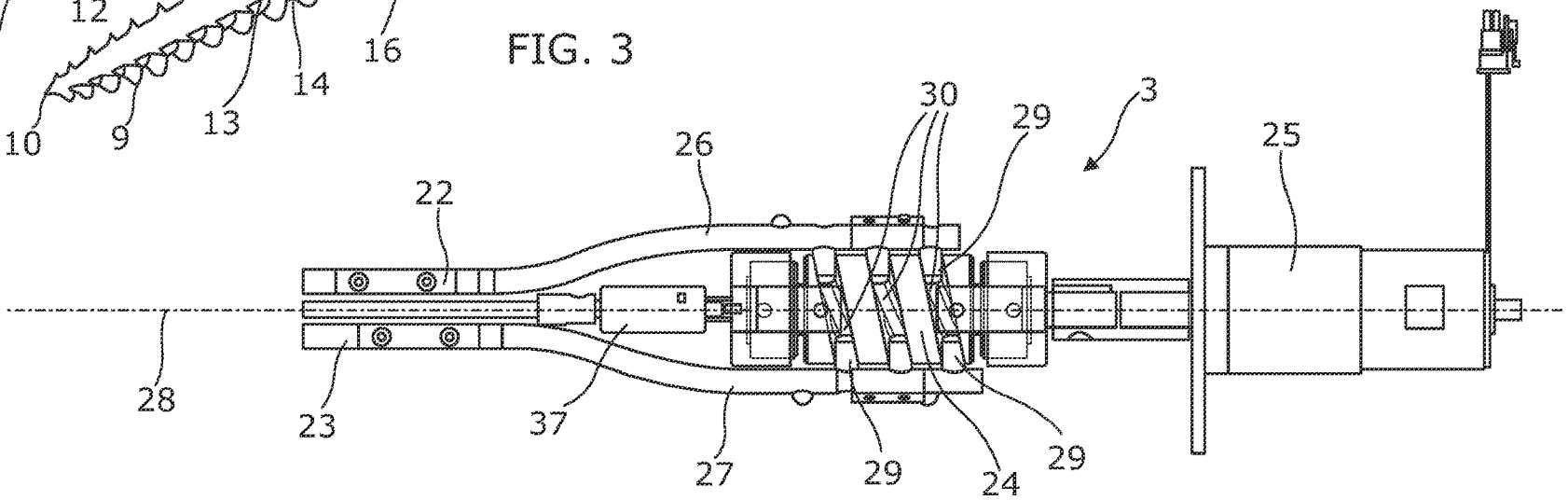
FIG. 4 shows a cam and follower mechanism of the drill of FIG. 1 to provide reciprocal motion to a first and second member.

FIG. 4 shows the actuation mechanism 3 of the drill 1 in more detail. The actuation mechanism 3 comprises a cylindrical cam 24 engaged with the first and second members 22, 23, and a motor 25 to actuate both the reciprocating and oscillation motion of the drill 1. Rotational movement of the motor 25 is transformed into reciprocation motion of the first and second members 22, 23 by the cam 24, wherein the first and second members 22, 23 act as dual followers.

The proximal end of the first member 22 comprises a first follower portion 26 and the proximal end of the second member 23 comprises a second follower portion 27. The follower portions 26, 27 are each angled away from a central axis 28 of the drill 1, to extend on opposite sides of the cam 24. The follower portions, 26, 27 comprise at least one follower protrusion 29, which engages with a groove 30 of the cam 24.

As the cam 24 is continuously rotated by the motor 25, both follower portions 26, 27 are moved forwards in a distal direction and backwards in a proximal direction, with an amplitude that is a function of the slope of the groove 30 of the cam 24. The reciprocating movement of the first and second follower portions 26, 27 provides linear reciprocating movement to the first and second parts 7, 8 of the drill bit 2 respectively. Where the first part 7 or the second part 8 of the drill bit 2 is in its proximal most position, this is the retracted position. Where the first part 7 or the second part 8 is in the retracted position, the other of the first part 7 or the second part 8 is in its distal most position, the extended position. Therefore, the reciprocating movement of the first and second follower portions 26, 27 provides linear reciprocating movement to the first and second parts 7, 8 between a retracted position and an extended position. This is described in more detail with reference to FIG. 6*a* to FIG. 6*d*.

The actuation mechanism 3 is located away from the medium to be drilled, at a proximal end of the drill 1, to avoid any particles or dust created from the drilling action, or present in the medium, from affecting the actuation mechanism 3, particularly the motor 25.

Figure 5:
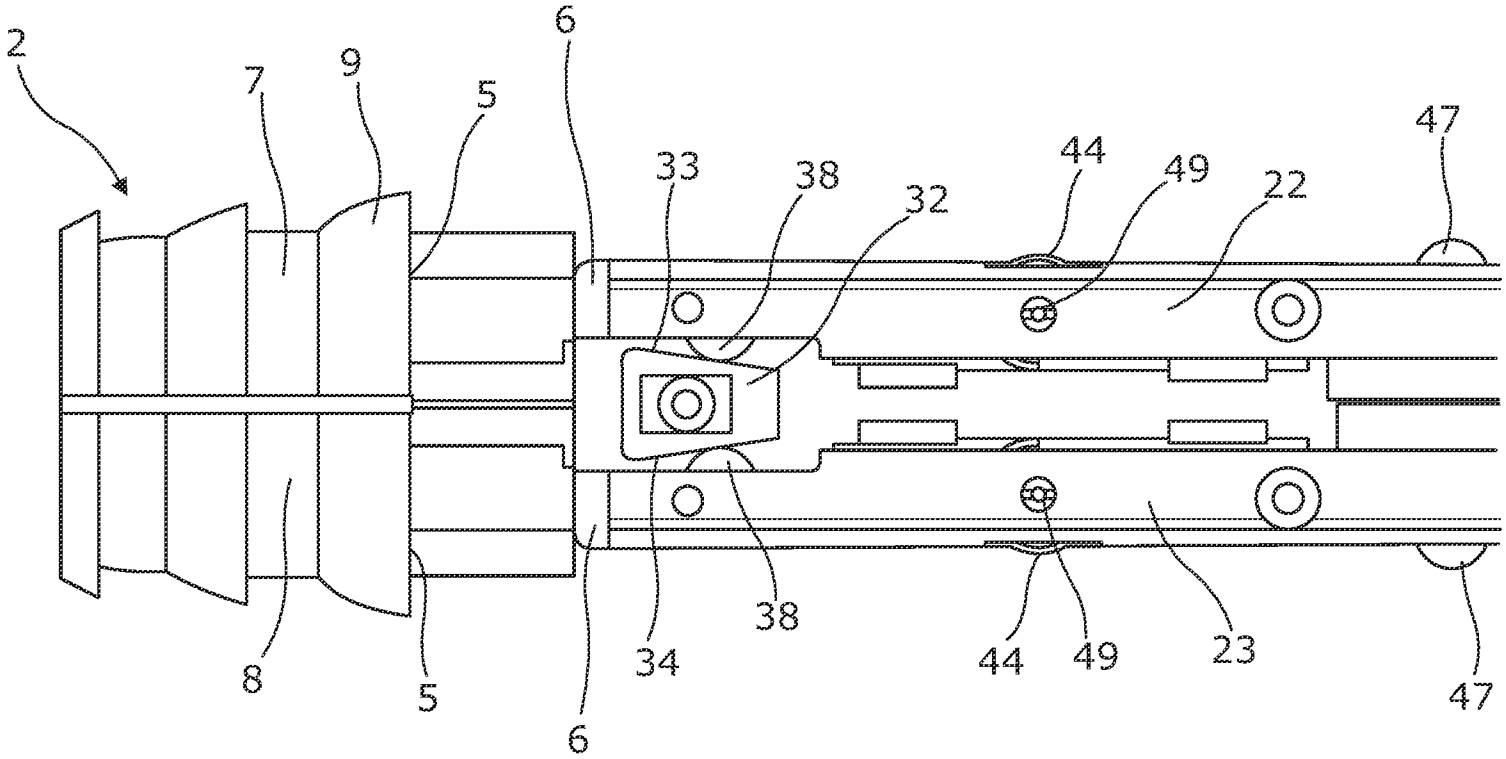
FIG. 5 shows an oscillating mechanism of the drill of FIG. 1 comprising a wedge.

FIG. 5 shows a wedge 32 of the drill 1, for providing oscillation movement to the drill bit 2 of the drill 1. The wedge 32 is disposed close to the base 5 of the drill bit 2 and between the first member 22 and the second member 23. The wedge 32, comprises a first angled surface 33 engaged with the first member 22 and a second angled surface 34 engaged with the second member 23. The wedge 32 is configured to urge the drill bit 2 to pivot in a first direction when the first member 22 is moved towards the retracted position and to pivot in a second direction when the second member 23 is moved towards the retracted position (as shown in FIG. 6*a* to FIG. 6*d*). This movement can be referred to as an oscillation or vibration motion.

Particularly, it is the oscillating rods 6 of the first and second members 22, 23 that engage the wedge 32. The oscillating rods 6 comprise contact points 38, in the form of protrusions or pins, which engage and slide along the angled surfaces 33, 34. As the reciprocating first and second members 22, 23, cause the contact points 38 to slide along the first and second angled surfaces 33, 34 of the wedge 32, the first and second members 22, 23 pivot about the oscillating rods 6.

The first angled surface 33 is symmetrical to the second angled surface 34. The first and second angled surfaces 33, 34 of the wedge 32 are a pair of surfaces having the same angle of incline, such that, in use, an angle through which the drill bit 2 pivots in the first direction is the same as an angle through which the drill bit 2 pivots in the second direction.

The drill 1, further comprises a biasing means 44, for example but not limited to a torsional spring or elastic member, acting on the first and the second members 22, 23 to urge the first and the second members 22, 23 towards engagement with the angled surfaces 33, 34 of the wedge 32. With the aid of the biasing means 44, the contact points 38 maintain continuous and full contact with the wedge 32 during a drilling operation. The oscillating rods 6 pivot about the hinge axis 49. Where the biasing means 44 is a torsional spring the torsional spring axis is at the same point as the hinge axis 49.

While the reciprocation motion mainly depends on the slope of the groove 30 of the cam 24, the oscillation or vibration motion depends on both the slope of the groove 30 of the cam 24 and the angle of the first and second angled surfaces 33, 34 of the wedge 32.

The first and second members 22, 23 also comprise supports 47 which are configured to contact and slide along an inner surface 48 of the outer shell of the stem 4. Advantageously the supports 47 improve the reciprocation motion of the first and second members 22, 23 within the stem 4. The supports 47 may be for example but not limited to pins, protrusions or bearings.

FIGS. 6*a* to 6*d* shows the reciprocation and oscillation motion of the drill bit 2 as the drill 1 is operating.

Figure 6D:
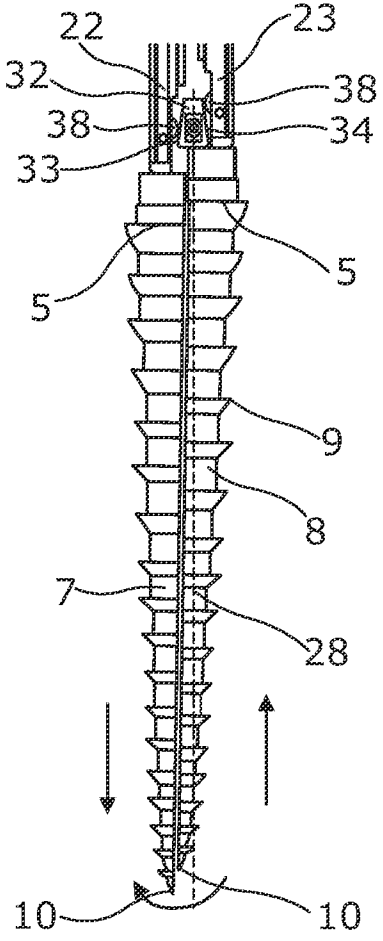
FIG. 6*d* shows the drill bit of FIG. 2 in a second position.
Figure 6C:
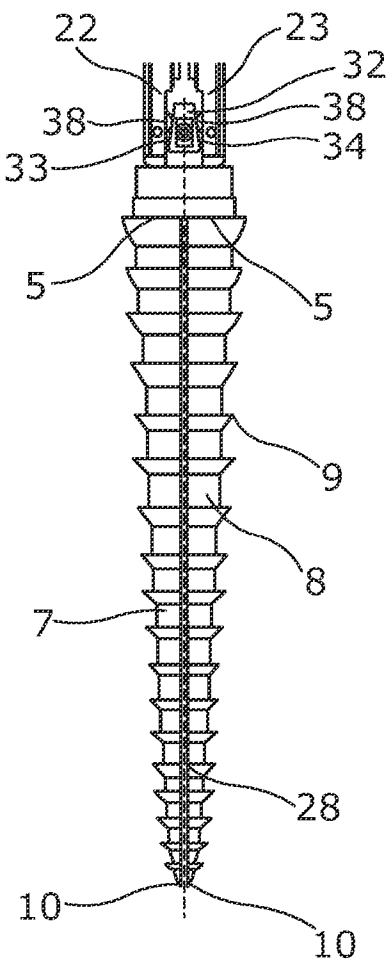
FIG. 6*c* shows the drill bit of FIG. 2 back in a neutral position.
Figure 6B:
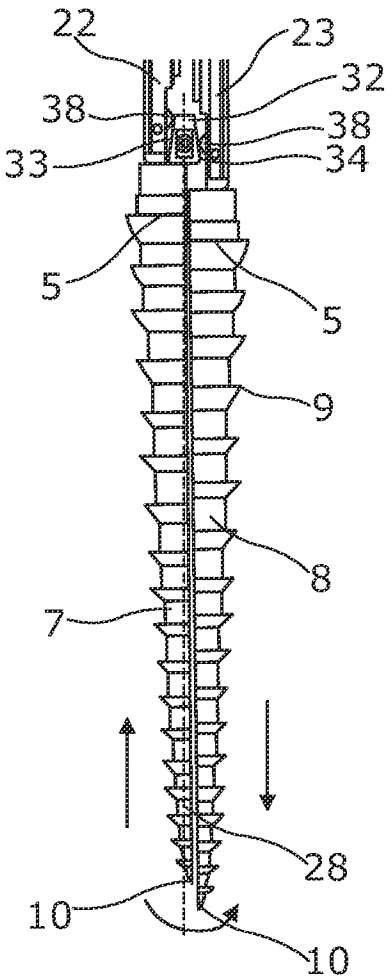
FIG. 6*b* shows the drill bit of FIG. 2 in a first position.
Figure 6A:
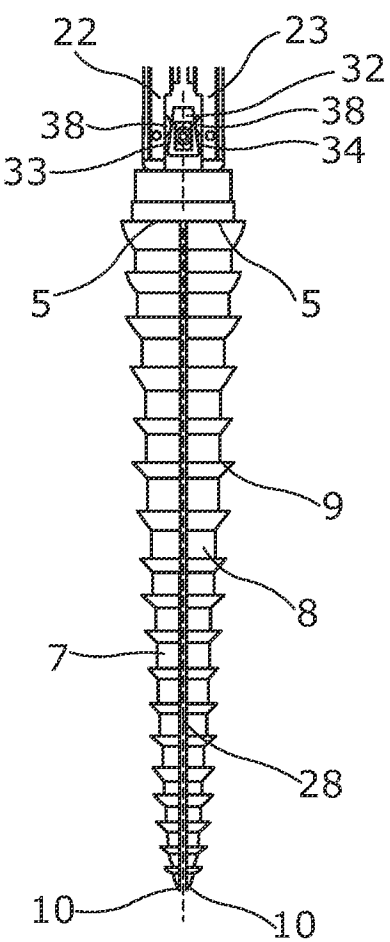
FIG. 6*a* shows the drill bit of FIG. 2 in a neutral position.

FIG. 6*a* shows the drill bit 2 in a neutral position. The neutral position is where neither the first part 7 nor the second part 8 is in the retracted or extended position. The contact points 38 of the first and second members 22, 23 are at the same position along the angled surfaces 33, 34 of the wedge 32, and therefore the drill bit 2 is not rotated towards a first direction or a second direction. The tip 10 and the base 5 of each of the first part 7 and the second part 8 are aligned.

FIG. 6*b* shows the drill bit pivoted in a first direction. As the cam 24 is rotated, the first follower 26 moves the first part 7 from the neutral position shown in FIG. 6*a*, towards the retracted position and the second follower 27 moves the second part 8 towards the extended position. The contact point 38 of the first member 22 is moved along the first angled surface 33, towards a proximal end of the wedge 32. The contact point 38 of the second member 23 is moved along the second angled surface 34 towards a distal end of the wedge 32. In this position the oscillating rods 6 are rotated with respect to the first and second members 22, 23, to pivot or swing the drill bit 2 in the first direction.

FIG. 6*c* shows the drill bit 2 back in the neutral position. As the cam 24 is rotated further, the first follower 26 moves the first part 7 from the retracted position shown in FIG. 6*b*, distally towards the neutral position and the second follower 27 moves the second part 8 proximally towards the neutral position. The contact points 38 of the first and second members 22, 23 are at the same position along the angled surfaces 33, 34 of the wedge 32, and therefore the drill bit 2 is not rotated towards a first direction or a second direction. The tip 10 and the base 5 of each of the first part 7 and the second part 8 are again aligned.

FIG. 6*d* shows the drill bit pivoted in a second direction. As the cam 24 is rotated the first follower 26 moves the first part 7 from the neutral position shown in FIG. 6*c*, towards the extended position and the second follower 27 moves the second part 8 towards the retracted position. The contact point 38 of the first member 22 is moved along the first angled surface 33, towards a distal end of the wedge 32. The contact point 38 of the second member 23 is moved along the second angled surface 34 towards a proximal end of the wedge 32. In this position the oscillating rods 6 are rotated with respect to the first and second members 22, 23, to pivot or swing the drill bit 2 in the second direction, opposite to the first direction.

As the cam 24 is rotated further, the first follower 26 moves the first part 7 from the extended position shown in FIG. 6*d*, proximally towards the neutral position of FIG. 6*a* and the second follower 27 moves the second part 8 distally towards the neutral position of FIG. 6*a*. The oscillation cycle can then be repeated.

During the operation of the drill as described with reference to FIG. 6*a* to FIG. 6*d*, as the first part 7 moves proximally the teeth 9 engage with the surrounding substrate, creating a traction force that is then transferred to a penetration force in the second part 8 that is moving distally. This assists the drill bit 2 to push further into the substrate or medium being drilled. Advantageously the ability to self-generate a penetration force greatly reduces the need for additional masses to create an overhead force, thus presenting a compact and lightweight drilling solution. Advantageously integrating the oscillation or vibration movement of the drill bit 2 swinging in a first and second direction with the reciprocation motion of the first and second members 22, 23 seeks to improve the drilling performance. Combining the oscillation motion with the reciprocation motion can enhance the penetration rate and reduce the drilling time and power of the drill 1.

Figures 7A, 7B:
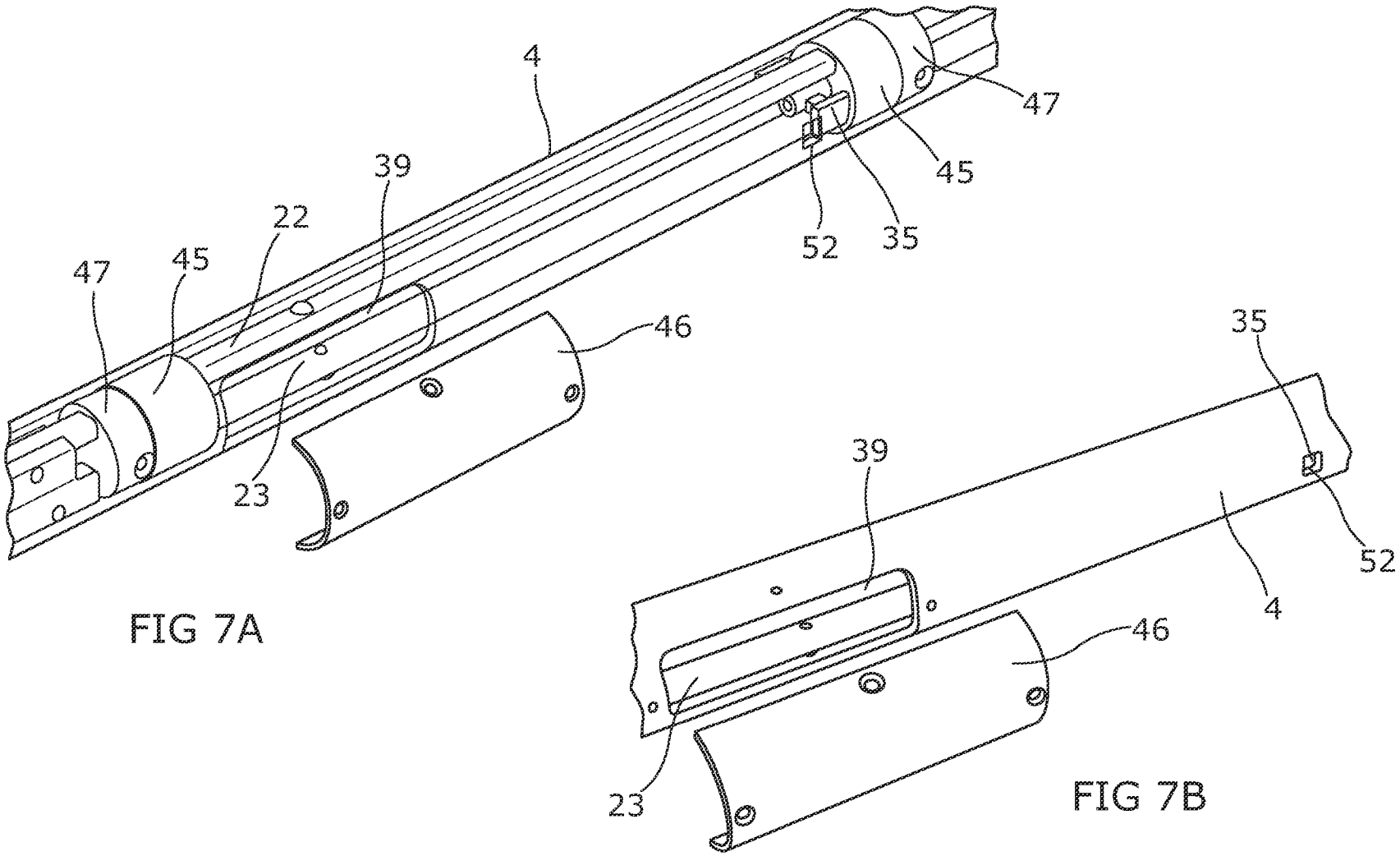
FIG. 7A shows a schematic view of an embodiment of the invention comprising a sampling chamber.
FIG. 7B shows a schematic view of the sampling chamber of FIG. 7A surrounded by a hollow outer shell.

As illustrated in FIG. 7A, in some embodiments, the drill 1 includes a sampling chamber 39 and an openable cover 35 (or openable shutter) to open and close the sampling chamber 39 for the ingress of material to be sampled. More particularly, the openable cover 35 opens and closes an aperture 52 in the stem 4 which provides access to the sampling chamber 39. The sampling chamber 39 is provided in the stem 4 at a location between the wedge 32 and the cam 24, wherein the wedge 32 is closer to the drill bit 2 than the cam 24. The drill 1 also comprises an access cover 46, to enable access to sampling chamber 39 to retrieve the sample.

The openable cover 35 is opened and closed by a latch which is moved by a linear actuator 37 (shown in FIG. 4) provided in the drill 1. The linear actuator 37 is located at a proximal end of the drill 1, such that it is located away from the medium to be drilled to avoid any particles or dust from the medium from affecting or damaging the linear actuator 37. The proximal and distal end of the sampling chamber 39 is sealed with a sealing member 45. The sealing member 45 aims to retain the sample within the sampling chamber 39. The sealing member 45 may be, for example but not limited to, a rubber bung or alternative polymer component.

Advantageously the openable cover 35 of the sampling chamber 39 may be opened for the ingress of material to be sampled at predefined depth, after penetrating the medium. As shown in FIG. 7A, the sampling chamber 39 has a length much greater than its width or diameter such that it provides enough space for the samples, but remains within the limits of the stem 4. This way the sampling chamber 39 does not cause a protuberance in the stem 4, which could impede the drilling action of the drill 1.

FIG. 7B shows how the sampling chamber 39, openable cover 35 and access cover 46 are positioned in the hollow cylindrical outer shell of the stem 4. The access cover 46 is openable by screws which are fixed in place during a drilling operation, alternatively opening the access cover 46 may be automated or latched.

Figure 8:
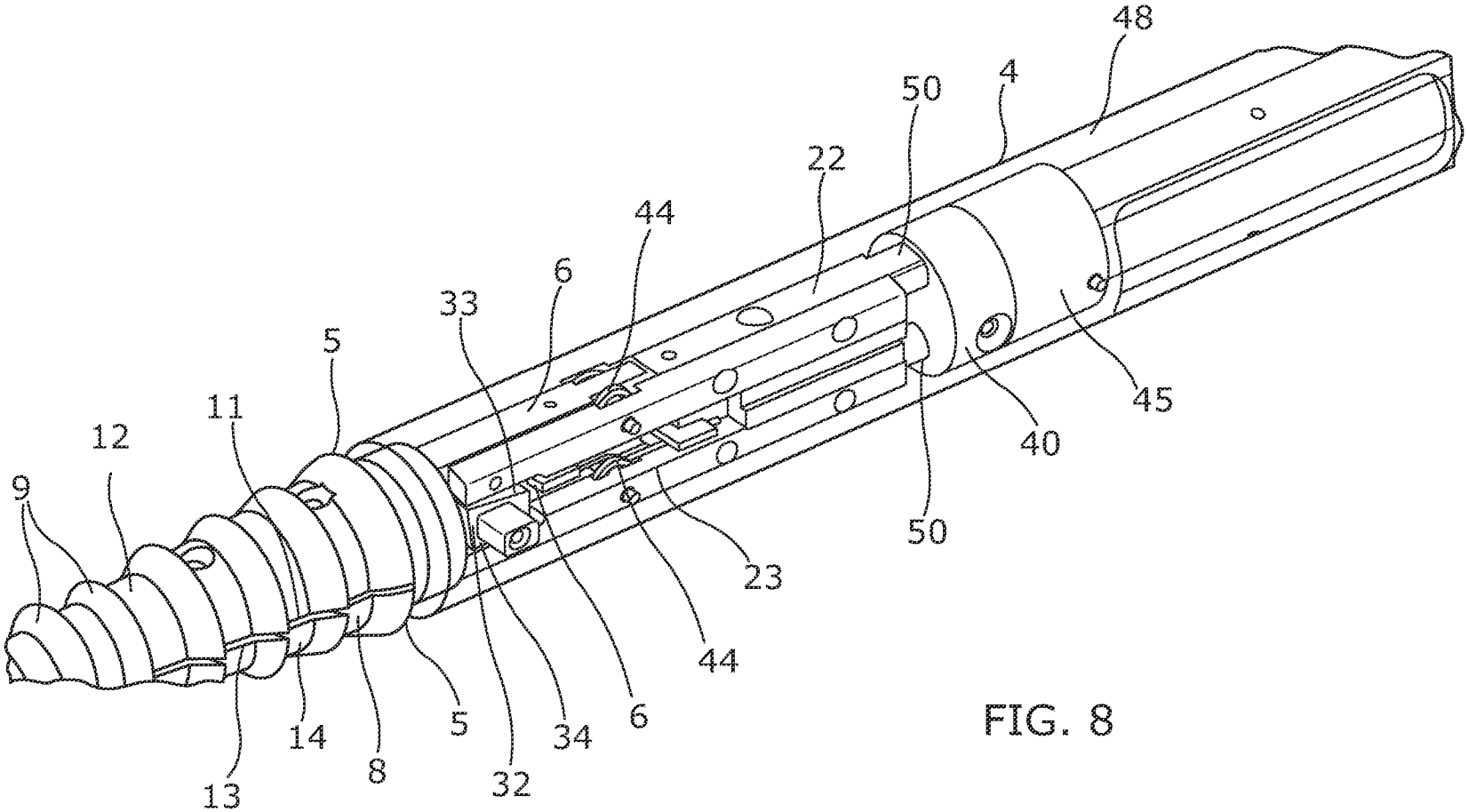
FIG. 8 shows a schematic view of an embodiment of the invention comprising a sleeve that guides the first and second members.

As illustrated in FIG. 8, in some embodiments the drill 1 comprises a guide member 40 surrounding the first and second members 22, 23. In the illustrated embodiment the guide member is a sleeve 40. The guide member 40 comprises slots 50 for receiving the first and second members 22, 23. The guide member 40 is fixed within the outer shell of the stem 4. The first and second members 22, 23 are configured to slide within the slots 50 of the guide member 40, which guides the reciprocation motion of the members 22, 23. This enables an optimised reciprocation motion and therefore enhances the efficiency of the system by reducing power losses in operating the drill.

Figure 9:
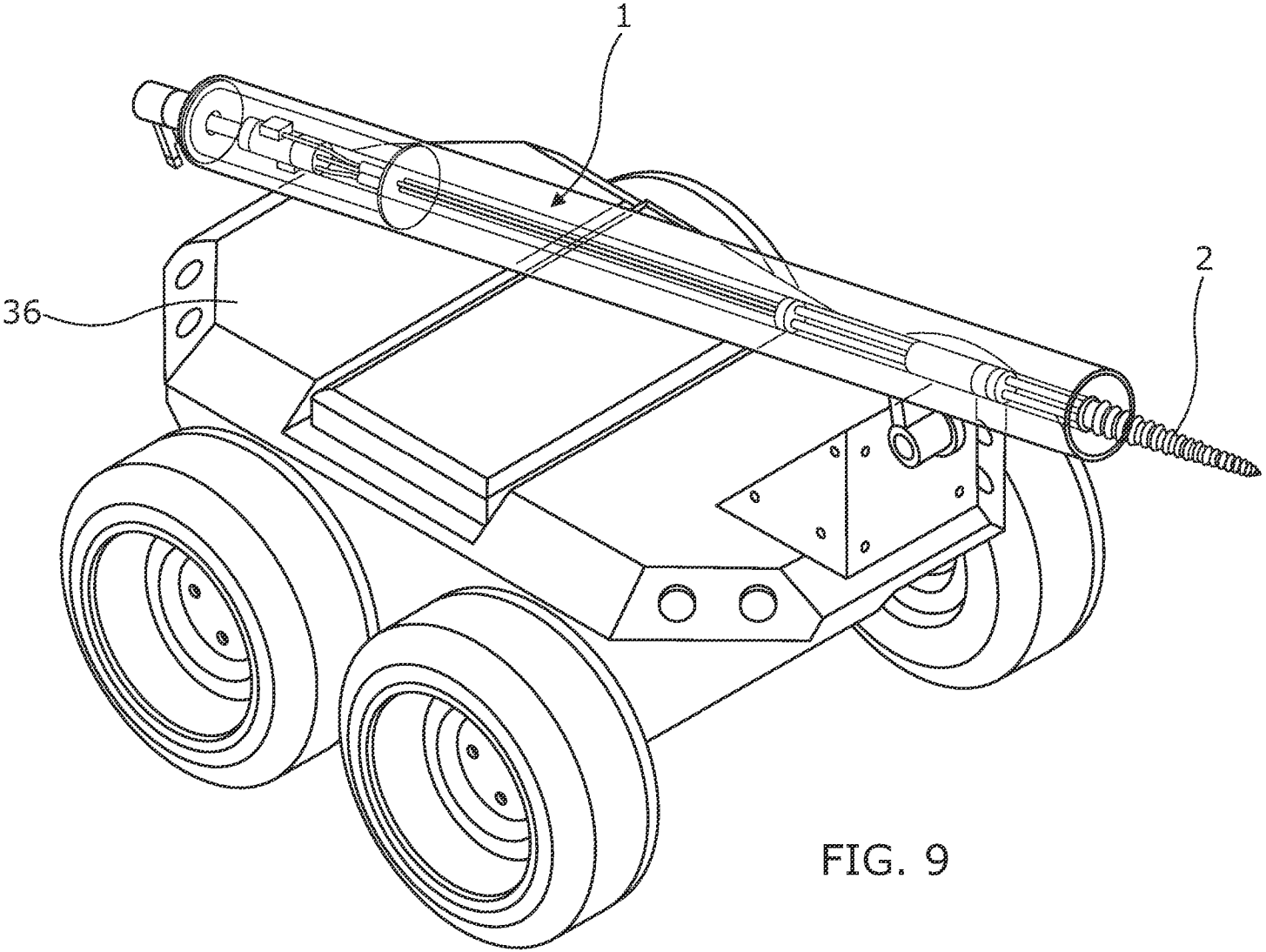
FIG. 9 shows an embodiment comprising the drill mounted on a vehicle.

As illustrated in FIG. 9, the drill 1 can be mounted on, or integrated with, a vehicle. One example application for the drill 1 is use in space. In such an application, the vehicle can be a rover 36 for driving over rough extra-terrestrial terrain by remote control. Advantageously for space, the drill 1 is lightweight and can be launched in a compacted form and then deployed on the extra-terrestrial terrain when needed for use. Due to the lightweight and compact nature of the drill 1, the rover 36 can be equipped with more than one drill 1. This will maximise the amount of samples which can be acquired in the duration of a space mission.

Figure 10:
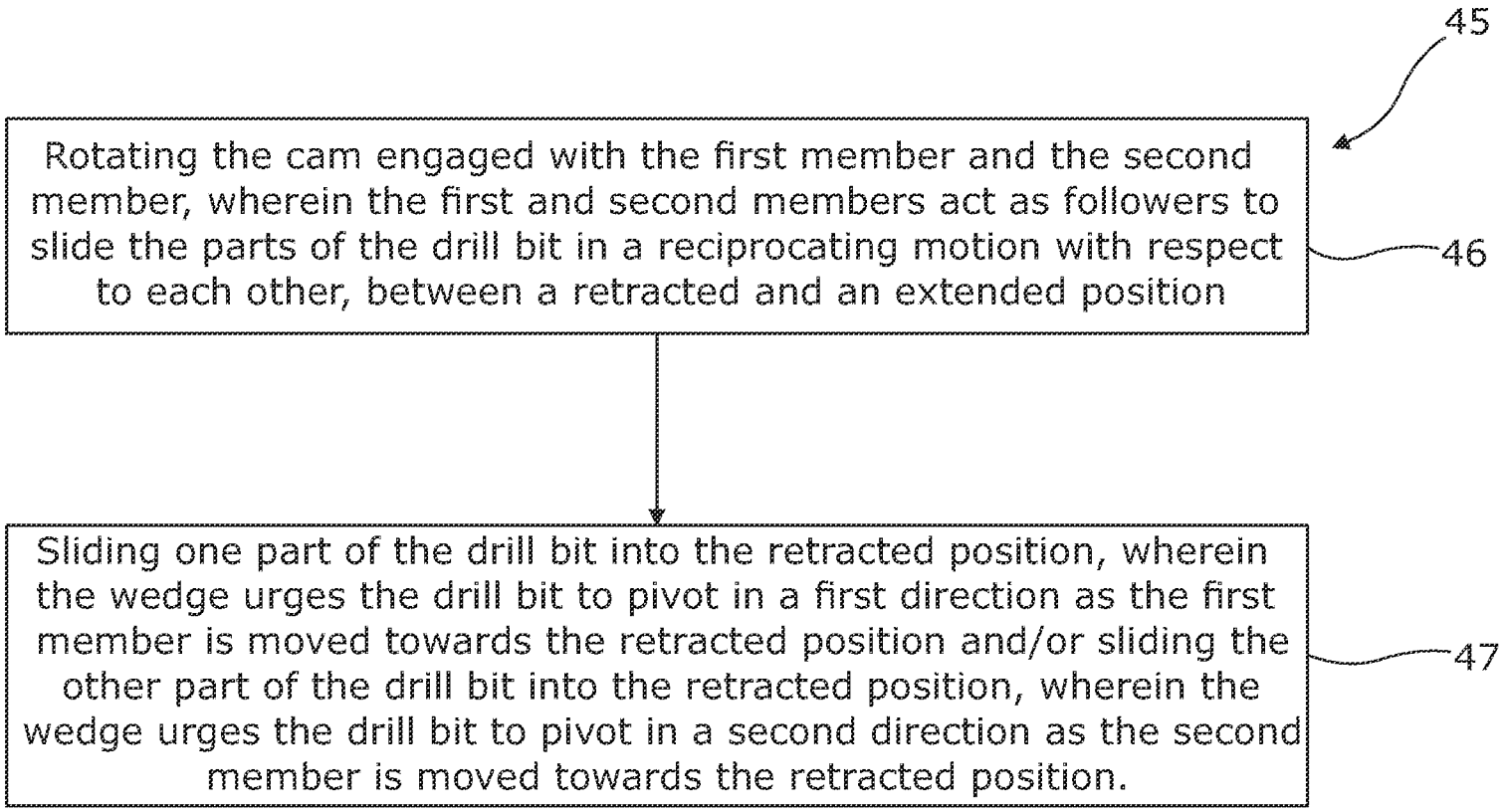
FIG. 10 shows a flowchart of a method of using the drill.

FIG. 10 is a flowchart of a method, indicated generally by the reference numeral 45, in accordance with an example embodiment. The method 45, shows how the drill 1 according to any embodiment described herein, may be used. The method 45 starts at operation 46, where the cam 24 engaged with the first member 22 and the second member 23 is rotated, wherein the first and second members 22, 23 act as followers to slide the parts 7, 8 of the drill bit 2 in a reciprocating motion with respect to each other, between a retracted and an extended position. At operation 47, one part of the drill bit 2 is slid into the retracted position, wherein the wedge 32 urges the drill bit 2 to pivot in a first direction as the first member 22 is moved towards the retracted position and/or the other part of the drill bit 2 is slid into the retracted position, wherein the wedge 32 urges the drill bit 2 to pivot in a second direction as the second member 23 is moved towards the retracted position.

In some embodiments the drill 1 is sealed and entirely encapsulated to protect it from external environmental conditions. In some embodiments it is the housing 43 which is entirely encapsulated. This is particularly relevant when the drill 1 is to be used in a location comprising tough environmental conditions, for example but not limited to, in space and in harsh weather conditions. The drill 1 may also be water tight for drilling in an underwater environment.

Advantageously the drill 1 provides a practical and durable design, having fewer moving parts than at least some prior art solutions. Having fewer moving parts can mean that the drill is less vulnerable to jamming and/or breakage. The drill 1 is also simpler to manufacture and assemble. Advantageously, a single motor may be used for both the reciprocation and oscillation motions described above. The drill 1 is compact and portable for attachment to other devices, or for use in many different locations. Advantageously the drill 1 is simple to deploy for use and stow when not in use. The drill 1 is also designed such that it can be used in harsh environmental conditions.

The drill 1 can be customised and optimised based on the desired application to provide different reciprocation and oscillation amplitudes just by changing the slope angle of the cylindrical cam grooves and the slope of the wedge angled surfaces, respectively.

Advantageously the drill 1 is also scalable. It can be envisaged that the drill 1 is used in a number of different applications. For example the drill 1 may be used in medical, oil and gas, space, terrestrial drilling and manufacturing applications, among others.

Many variants of the example embodiments described above and discussed below. The skilled person will be aware of further variants and modifications that may be made to the embodiments described herein.

In the above described embodiments the drill bit 2 comprises two halves, the first drill part 7 and the second drill part 8. However, in alternative embodiments intended within the scope of the present disclosure, the first drill part 7 may be of a different size and/or shape to the second drill part 8.

In the above described embodiments the drill bit 2 comprises two parts, the first drill part 7 and the second drill part 8. However, in alternative embodiments intended within the scope of the present disclosure, the drill bit 2 comprises more than two parts configured to slide relative to each other.

In some embodiments the drill bit 2 is removable and replaceable. The drill 1 may be usage with a variety of different customised drill bits 2. Advantageously if a drill bit 2 is damaged or if a different drill bit 2 is required to better suit the medium to be drilled, then the drill bit 2 can be changed.

In the above described embodiments the teeth 9 of the first drill part 7 are substantially symmetrical to the teeth 9 of the second drill part 8. However, in alternative embodiments intended within the scope of the present disclosure, the teeth 9 of the first drill part 7 can be different to the teeth 9 of the second drill part 8. In some embodiments only one of the first drill part 7 and the second drill part 8 comprises teeth 9.

In the above described embodiments the first mating face 11 is configured to engage the second mating face 13 via an interlocking connection 15. However, it can be appreciated that there are alternative known connection means which would enable the first part 7 to slide relative to the second part 8.

In the above described embodiments the teeth 9 are spaced along a length of the first part 7 and the second part 8. However, in alternative embodiments intended within the scope of the present disclosure, the teeth 9 are spaced along a portion of the first part 7 and/or the second part 8.

In the above described embodiments the first mating face 11 comprises the track 17 and the second mating face 13 comprises the pin 16. However, in alternative embodiments intended within the scope of the present disclosure, the second mating face 13 comprises the track 17 and the first mating face 11 comprises the pin 16. In some embodiments both the first and second mating faces 11, 13 comprise both a track 17 and a pin 16.

In the above described embodiments the head 20 and track 17 are rounded in shape. However, it can be appreciated that in alternative embodiments intended within the scope of the present disclosure, the head can be for example but not limited to, a cube, a disc, a cylinder, a cone or a hemisphere and fulfil the same purpose.

In the above described embodiments the head 20 is fully retained within the track 17. However, in alternative embodiments intended within the scope of the present disclosure, the track 17 can merely receive and guide the pin 16 and not fully retain it. For example the pin 16 may not comprise a neck 21, the pin 16 may comprise a ridge extending along a mating face 11, 13 of the first and/or second part 7, 8, which is triangular in cross section. The track 17 may comprise a complimentary V-shaped notch to receive the triangular ridge. This configuration still prevents lateral movement or rotation of the first and second parts 7, 8 relative to each other.

In the above described embodiments the first angled surface 33 is symmetrical to the second angled surface 34. However, in alternative embodiments intended within the scope of the present disclosure, the first angled surface 33 comprises a steeper or shallower angle of incline with respect to the central axis 28 of the drill 1, than the second angled surface 34. This is such that the drill bit 2 oscillates further in one direction than it does in the other.

In the above described embodiments in the neutral position the contact points 38 of the first and second members 22, 23 are at the same position along the angled surfaces 33, 34 of the wedge 32. However, in alternative embodiments intended within the scope of the present disclosure the contact points 38 may be of different sizes, and/or the angled surfaces 33, 34 may be of different slopes. In these embodiments, in the neutral position the contact points 38 of the first and second members 22, 23 may not be at the same position along the angled surfaces 33, 34 of the wedge 32.

In the above described embodiments the wedge 32 comprises a pair of angled surfaces. However, in alternative embodiments intended within the scope of the present disclosure, the drill 1 can be converted from a reciprocation and oscillation drill, to a reciprocation only mode by replacing the wedge 32 with a straight block and/or fixing the hinge joints or oscillating rod 6.

In the above described embodiments the torsional spring axis is at the same point as the hinge axis 49. However, in alternative embodiments intended within the scope of the present disclosure, the hinge axis 49 and/or the torsional spring axis may be provided at an alternative location.

In the above described embodiments the drill 1 comprises an openable cover 35 and an access cover 46. However, in alternative embodiments intended within the scope of the present disclosure, the openable cover 35 and the access cover 46 can be the same component.

In the above described embodiments the guide member 40 is a sleeve to guide the first and second members 22, 23 as they reciprocate. However, in alternative embodiments intended within the scope of the present disclosure alternative guide members can be envisaged. For example, the guide member may be a pin and track connection wherein at least one of the outer shell of the stem 4 and the members 22, 23 comprises a protrusion and the other of the outer shell of the stem 4 and the members 22, 23 comprises a receiving portion, such as a groove. The protrusion is guided in the receiving portion to guide the reciprocal motion of the members 22, 23.

In the above described embodiments the guide member 40 is fixed within the outer shell of the stem 4. However, in alternative embodiments intended within the scope of the present disclosure the guide member 40 may be moveable.

It will be appreciated that the above described example embodiments are purely illustrative and are not limiting on the scope of the invention. Other variations and modifications will be apparent to persons skilled in the art upon reading the present specification.

Moreover, the disclosure of the present application should be understood to include any novel features or any novel combination of features either explicitly or implicitly disclosed herein or any generalization thereof and during the prosecution of the present application or of any application derived therefrom, new claims may be formulated to cover any such features and/or combination of such features.

Although various aspects of the invention are set out in the independent claims, other aspects of the invention comprise other combinations of features from the described example embodiments and/or the dependent claims with the features of the independent claims, and not solely the combinations explicitly set out in the claims.

The invention claimed is:

1. A drill comprising:

a drill bit comprising a first drill part and a second drill part configured to slide relative to each other, wherein the first and second drill parts are pivotally coupled at one end to a first member and a second member respectively;

a cam engaged with the first member and the second member, wherein the first and second members act as followers to slide the parts of the drill bit in a reciprocating motion with respect to each other, between a retracted and an extended position; and a wedge comprising a first angled surface engaged with the first member and a second angled surface engaged with the second member, the wedge configured to urge the drill bit to pivot in a first direction when the first member is moved towards the retracted position and to pivot in a second direction when the second member is moved towards the retracted position.

2. The drill according to claim 1, wherein the cam is a cylindrical cam and the first and second members extend on opposite sides of the cylindrical cam to transform rotational movement of the cylindrical cam to a linear reciprocating motion of the first and second members.

3. The drill according to claim 1, further comprising a motor to actuate both the reciprocating and pivot motions.

4. The drill according to claim 1, wherein the first and second angled surfaces of the wedge are a pair of surfaces having the same angle of incline, such that, in use, an angle through which the drill bit pivots in the first direction is the same as an angle through which the drill bit pivots in the second direction.

5. The drill according to claim 1, wherein the first member comprises a hinge joint to pivotally couple to the first drill part and the second member comprises a hinge joint to pivotally couple to the second drill part.

6. The drill according to claim 5, wherein the hinge joints comprise rounded contact points that engage each angled surface of the wedge.

7. The drill according to claim 1, further comprising a biasing means acting on the first and the second member to urge the first and the second members towards engagement with the angled surfaces of the wedge.

8. The drill according to claim 1, wherein the first drill part is coupled to the second drill part by an interlocking connection that prevents lateral movement or rotation of the first drill part relative to the second drill part.

9. The drill according to claim 8, wherein one of the first drill part and the second drill part comprises a pin and the other of the first drill part and the second drill part comprises a track, wherein the pin is configured to travel within the track.

10. The drill according to claim 1, further comprising a chamber for the ingress of material to be sampled.

11. The drill according to claim 10, further comprising an openable cover to open and close the chamber.

12. The drill according to claim 10, wherein the chamber is provided at a location between the wedge and the cam, wherein the wedge is closer to the drill bit than the cam.

13. The drill according to claim 1, further comprising a guide member for engagement with the first member and the second member, wherein the guide member comprises at least two slots and the first member and the second member are configured to slide within said slots to guide the reciprocation motion.

14. The drill according to claim 1, wherein the drill comprises a sealed housing to encapsulate the first and second members, the wedge and the cam, to protect them from external environmental conditions.

15. A method of using the drill according to claim 1, wherein the method comprises:

rotating the cam engaged with the first member and the second member, wherein the first and second members act as followers to slide the parts of the drill bit in a reciprocating motion with respect to each other, between a retracted and an extended position; and sliding one part of the drill bit into the retracted position, wherein the wedge urges the drill bit to pivot in a first direction as the first member is moved towards the retracted position and/or sliding the other part of the drill bit into the retracted position, wherein the wedge urges the drill bit to pivot in a second direction as the second member is moved towards the retracted position.

* * * * *